US009580215B2

(12) United States Patent
Anderson et al.

(10) Patent No.: US 9,580,215 B2
(45) Date of Patent: Feb. 28, 2017

(54) PACKAGE OR PRODUCT HAVING A USE INDICATOR

(71) Applicant: Owens-Brockway Glass Container Inc., Perrysburg, OH (US)

(72) Inventors: Chris D. Anderson, Perrysburg, OH (US); Megan Herman, Toledo, OH (US); Brad Malcolm, Ivanhoe (AU); Paola A. Rubiano, Medelin (CO)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

(21) Appl. No.: 14/691,722

(22) Filed: Apr. 21, 2015

(65) Prior Publication Data

US 2015/0225143 A1 Aug. 13, 2015

Related U.S. Application Data

(62) Division of application No. 13/832,729, filed on Mar. 15, 2013, now abandoned.

(51) Int. Cl.

| | |
|---|---|
| ***B65D 55/02*** | (2006.01) |
| ***B65D 50/00*** | (2006.01) |
| ***B65D 85/00*** | (2006.01) |
| ***B65B 3/02*** | (2006.01) |
| ***B65B 7/00*** | (2006.01) |
| ***B65B 69/00*** | (2006.01) |

(52) U.S. Cl.

CPC ..... *B65D 50/00* (2013.01); *B65B 3/02* (2013.01); *B65B 7/00* (2013.01); *B65B 69/00* (2013.01); *B65D 55/026* (2013.01); *B65D 85/00* (2013.01)

(58) Field of Classification Search

CPC ..... B65D 55/026; B65D 55/00; B65D 55/02; B65D 23/02; B65D 55/0818; B65D 41/0435; B65D 1/023

USPC ..... 206/459.1, 807; 215/230; 283/95, 72

See application file for complete search history.

(56) References Cited

U.S. PATENT DOCUMENTS

| | | | | |
|---|---|---|---|---|
| 3,899,295 | A * | 8/1975 | Halpern | A61L 2/28 101/491 |
| 4,505,399 | A * | 3/1985 | Weiner | B65D 55/026 215/203 |
| 4,511,052 | A * | 4/1985 | Klein | B65D 55/026 116/200 |
| 4,755,405 | A * | 7/1988 | Massucco | B29C 49/22 206/459.1 |
| 4,813,541 | A * | 3/1989 | Velasco | B65D 55/026 206/459.1 |
| 4,816,305 | A * | 3/1989 | Stillwell | B65D 1/0215 206/459.1 |
| 4,986,429 | A * | 1/1991 | Singleton, Jr. | B65D 41/62 206/459.1 |
| 5,617,812 | A * | 4/1997 | Balderson | B65D 51/244 116/206 |
| 6,378,906 | B1 * | 4/2002 | Pennaz | G09F 3/02 106/31.32 |
| 2010/0155357 | A1 * | 6/2010 | Dennis | B32B 27/065 215/347 |

(Continued)

*Primary Examiner* — Steven A. Reynolds

(57) ABSTRACT

A product includes a use indicator carried inside a container so that, upon removal of a closure from the container or upon removal of flowable product from within the container, a coloration of the product changes irreversibly to indicate to a user that the package has been used.

12 Claims, 10 Drawing Sheets

(56) References Cited

U.S. PATENT DOCUMENTS

| | | | | |
|---|---|---|---|---|
| 2014/0116009 | A1* | 5/2014 | Herman | B65D 23/02 53/467 |
| 2014/0260116 | A1* | 9/2014 | Cooper | B65D 25/00 53/492 |

* cited by examiner

PACKAGE OR PRODUCT HAVING A USE INDICATOR

The present disclosure is directed to packages and, more particularly, to packages having anti-counterfeit features.

BACKGROUND AND SUMMARY OF THE DISCLOSURE

Many containers are provided with tamper-resistant devices to resist refilling of contents in the containers. For example, a container for carrying a liquid product can include a fitment that renders the container non-refillable, so as to impede efforts to refill the container with inferior products. U.S. Pat. No. 3,399,811 illustrates a container of this type.

A general object of the present disclosure, in accordance with one aspect of the disclosure, is to provide a product and/or package including a container and a use-evident indicator for indicating that the product and/or package has been used, for example, by opening of the package and/or by dispensing or other removal of original flowable product from the container.

The present disclosure embodies a number of aspects that can be implemented separately from or in combination with each other.

A product in accordance with one aspect of the disclosure includes a container, and a use indicator carried inside the container so that, upon removal of a closure from the container or upon removal of flowable product from within the container, a coloration of the product changes irreversibly to indicate to a user that the package has been used.

In accordance with another aspect of the disclosure, there is provided a method of producing a product that includes the steps of (a) positioning an indicator inside of a container, wherein the indicator has a coloration state changeable to another coloration state in response to use of the product, (b) flowing a flowable product into the container to at least partially cover the indicator, and (c) assembling a closure to the container.

In accordance with a further aspect of the disclosure, a product includes a container, and a use indicator carried by the container so that, upon removal of a closure from the container or upon removal of flowable product from within the container, a coloration of the product changes irreversibly to indicate to a user that the package has been used, wherein the container includes a wall recess and the use indicator is carried in the wall recess.

In accordance with an additional aspect of the disclosure, there is provided a method of discouraging reuse of a container after opening of the container, which includes the step of: applying a permanent discoloration to the container, which is observable by a potential user to indicate that the container has already been used.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
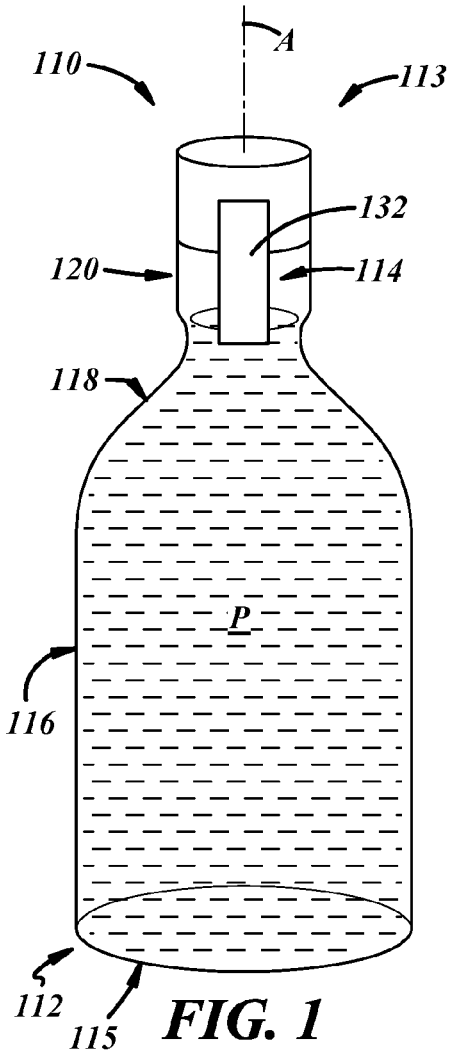
FIG. 1 is a perspective view of a package in accordance with an illustrative embodiment of the present disclosure, including a container holding a flowable product, a closure coupled to the container, and a use indicator coupled to exterior surfaces of the container and the closure and shown in an initial or unactivated state.

FIG. 1 illustrates a package 110 in accordance with an illustrative embodiment of the disclosure as including a container 112 for containing an original flowable product P, a closure 113 coupled to the container 112 and a use indicator 114 coupled to exterior surfaces of the container 112 and the closure 113. As used herein, the term "use" may include design intent use, for example, package opening, product dispensing, and/or the like, but also may include unintended or unauthorized use, for example, product withdrawal, for instance, via suction, or the like. As will be described below, upon removal of the closure 113 from the container 112, a coloration of the package 110 visible from outside of the container 112 changes irreversibly to indicate to a user that the package 110 has been opened. As used herein, the term "coloration" includes color, hue, transparency, and/or any other suitable coloration qualities. Likewise, the term "discoloration" includes a change in state of coloration and may be carried out by, for instance, staining, etching, or any other suitable discoloration modes.

The discoloration of the package 110 may be established by discoloration of the container 112, of the closure 113, and/or of the indicator 114, and a state of the coloration may change, for instance, from one color to another, from a hue of a color to another hue of that same color, from transparent to translucent or vice-versa, from transparent or translucent to opaque or vice-versa, and/or any other suitable discoloration or state change. As used herein, the terminology "closure removal" or "removal of the closure" may include partial or complete removal of the closure from the container and also may include the act of removing the closure from the container. Also, as used herein, the term "visible" includes visible to a human eye with or without aid of a special light, for example, an ultraviolet light, or the like. Accordingly, the state change of the coloration may be overt (visible to the human eye in natural daylight) or covert (visible to the human eye in the presence of a special light). The state change will deter a counterfeiter from refilling and/or repackaging the container 112 with counterfeit product.

Referring again to FIG. 1, the container 112 may be of one-piece integrally formed construction, preferably glass or plastic construction. (The term "integrally formed construction" does not exclude one-piece integrally molded layered glass constructions of the type disclosed for example in U.S. Pat. No. 4,740,401, or one-piece glass bottles to which other structure is added after the bottle-forming operation.) The container 112 may be fabricated in press-and-blow or blow-and-blow glass container manufacturing operations, or in plastic injection and/or blow molding operations, or in any other suitable manner.

The container 112 may include a base 115 on which the container 112 may be supported, a body 116 extending axially from the base 115, a shoulder 118 extending radially and axially from the body 116, and a neck 120 extending axially from the shoulder 118. As used herein, the term axial includes oriented generally along a longitudinal axis of the closure 113, container 112, or package 110 and may include but is not limited to a direction that is strictly parallel to a container longitudinal central axis A. The neck 120 may include a neck finish 122 (FIG. 2), which may include one or more closure engagement features 124 (FIG. 2), which may include thread segments, bayonet features, or any other suitable engagement features. As used herein, the term thread segment includes whole, partial, multiple, and/or an interrupted thread and/or thread segment. The container 112 may be of any suitable shape. For example, the body 116 and the neck 120 may be generally cylindrical, as illustrated, or they may be elliptical, tapered or of any other suitable shape.

The closure 113 may include a twist-off cap, pull cork, plug, or any other suitable closure. In the illustrated embodiment, the closure 113 may include one or more container engagement features (not shown) for cooperation with the closure engagement feature(s) of the container 112. The closure 113 also may include any suitable seal(s) (not shown) or the like for sealing coupling to the container 112, and any suitable cover (not shown), which may include a metal foil, plastic cup, wax seal, or any other suitable covering.

The flowable product P may be dispensably disposed within the container 112, and the closure 113 may be sealingly coupled to the container 112 to establish a package that is factory sealed or in its original factory sealed state or condition. For example, a beverage manufacturer may fill the container 112 with an authentic or original beverage at a packaging plant or factory, and then close the container 112 with the closure 113 and, optionally, with a cover (not shown). The flowable product P may include any liquid or flowable solid, for instance, a food, or a beverage, for instance, beer, wine, liquor, soda, other beverage, or any other suitable liquid or flowable food product. Accordingly, the package 110 leaves the packaging plant in an original factory sealed condition. Thereafter, the closure 113 (and cover) may be removed from the container 112.

The indicator 114 may be non-removably secured to the container 112, or coupled to the container 112 in any other suitable manner. The terminology "non-removably secured" includes a manner in which the indicator 114 is, by design-intent, not intended to be removed from the container 112 without damaging the container 112 and/or indicator 114 or otherwise visibly compromising the structural and/or functional integrity of either or both. The indicator 114 is illustrated in FIG. 1 in an initial or unactivated state.

The indicator 114 may be of any suitable composition(s) and constructed in any suitable manner to enable the package 110 to exhibit one or more different colorations when the closure 113 is removed from the container 112, for instance, discoloration or staining of the container 112. For example, the indicator 114 may be constructed as a sticker that may be non-removably secured to the container 112 and the closure 113 by an adhesive. The sticker may include a hollow casing or housing 132 and an indicating liquid 134 (FIG. 2), which may be carried in the hollow casing 132 in a sealed manner. The indicating liquid may include a stain, dye, ink, etchant, or any other suitable material to irreversibly or permanently discolor one or more surfaces of the container 112, such that a counterfeiter cannot reverse the discoloration without compromising the structural integrity of some aspect of the package 110.

Figure 2:
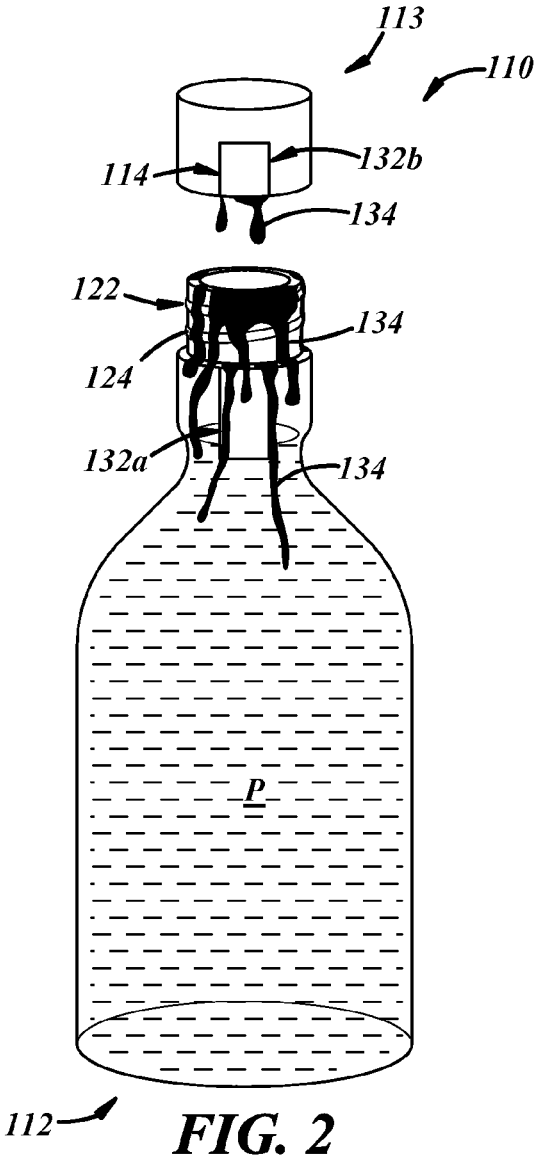
FIG. 2 is an exploded perspective view of the package of FIG. 1, illustrating the closure removed from the container and the use indicator in a ruptured or activated state and a permanent discoloration on the container.

Accordingly, and with reference to FIG. 2, when the closure 113 is removed from the container 112 for the first time, the indicator 114 ruptures into at least two portions 132*a*, 132*b* such that the indicating liquid 134 is released and flows over and permanently discolors one or more surfaces of the container 112. Accordingly, surfaces of the container 112 itself become discolored. Accordingly, such container surfaces are preferably not covered with labels, seals, or the like.

The container 112 may be substantially or completely emptied of its original flowable product P. Thereafter, if counterfeiters attempt to refill the emptied container 112 with counterfeit product and repackage the container 112 with the closure 113, the refilled and repackaged package 110 will include the stained container 112 as evidence of refilling and repackaging. Therefore, the indicator 114 may provide an anti-counterfeiting feature to the package 110.

Figure 3:
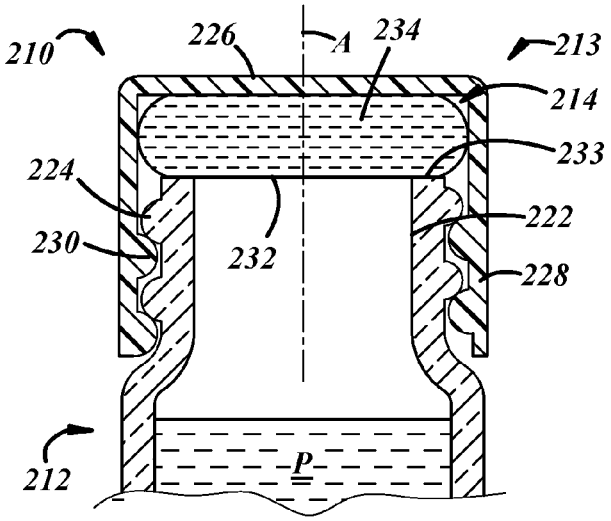
FIG. 3 is an elevational, fragmentary, cross-sectional view of a portion of a package in accordance with an additional illustrative embodiment of the present disclosure, including a container, a closure coupled to the container, and a use indicator coupled to the container and positioned between the closure and the container.
Figure 4:
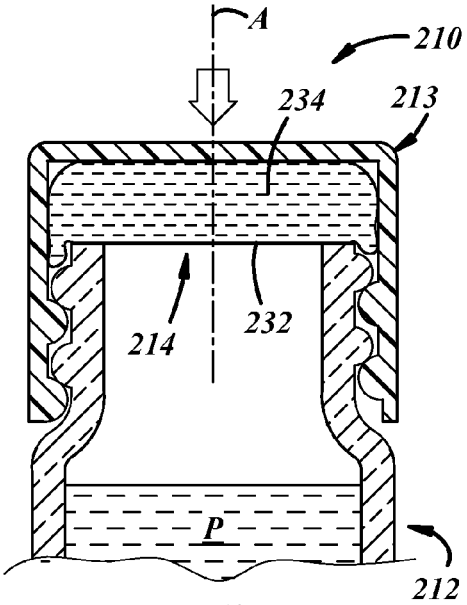
FIG. 4 is an elevational, fragmentary, cross-sectional view of the package of FIG. 3, illustrating the closure being pushed toward the container and the use indicator being compressed between the closure and the container so as to activate or rupture the use indicator.
Figure 5:
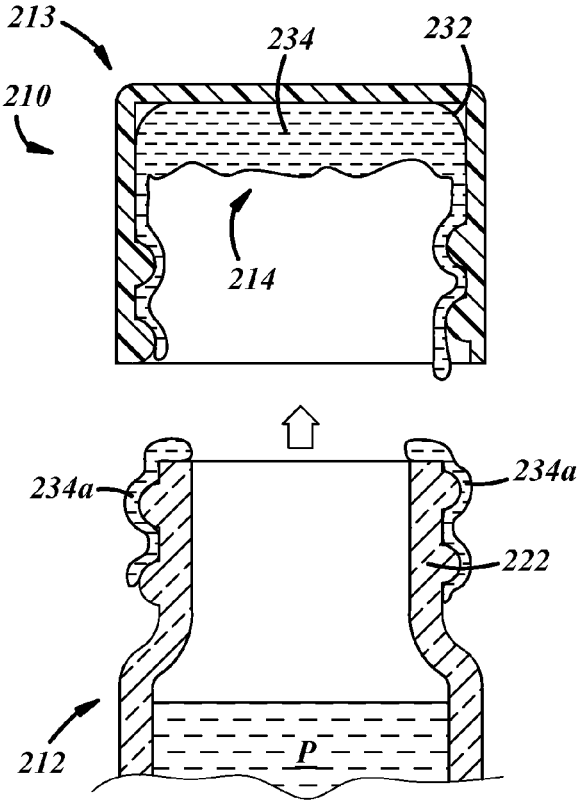
FIG. 5 is an exploded, elevational, fragmentary, cross-sectional view of the package of FIG. 4, illustrating the closure removed from the container and the use indicator in a ruptured or activated state and a permanent discoloration on the container.

FIGS. 3-5 illustrate another embodiment of a package 210. This embodiment is similar in many respects to the embodiment of FIGS. 1-2 and like numerals among the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 3, a package 210 includes a container 212, a closure 213 coupled to the container 212, a use indicator 214 carried between the closure 213 and the container 212, and a flowable product P carried in the container 212. The container 212 includes a neck finish 222 to which the closure 213 may be coupled, for example, via one or more closure engagement elements 224. The neck finish 222 also may include an axial end surface or lip 233. The closure 213 may include a base wall 226 and a skirt 228 extending axially from the base wall 226 and including one or more container engagement elements 230 for cooperation with the closure engagement element(s) 224.

The indicator 214 may include a housing 232 and an indicating liquid 234 carried in the housing 232. The housing 232 may include a membrane, skin, or any other suitable liquid impermeable material to contain the indicating liquid 234. The indicator 214 may be axially trapped and in direct contact with the base wall 226 of the closure 213 and the lip 233 of the container 212. In FIG. 3, the indicator 214 is illustrated in an initial or unactivated state.

With reference to FIG. 4, the closure 213 may be a push-and-turn type of closure that requires a user to push the closure 213 toward the container 212 before rotating the closure 213 during removal of the closure 213 from the container 212. Push-and-turn closures are well known to those of ordinary skill in the art in any suitable type of push-and-turn closure may be used. For example, instead of thread type engagement elements as illustrated in the drawing figures, bayonet and lug type engagement elements could be used that require user to push-and-turn the closure 213 to remove it from the container 212. In another example, the closure 213 may include a multiple piece push-and-turn closure assembly that requires a user to push-and-turn the closure 213 to remove it from the container 212. In any case, when the closure 213 is pushed toward the container 212 during closure removal, the indicator 214 is compressed between the closure 213 and the container 212 so as to rupture the housing 232 and liberate the indicating liquid 234.

With reference to FIG. 5, the housing 232 is ruptured as a result of push-and-turn removal of the closure 213 such that the indicating liquid 234 is released and flows over and permanently discolors one or more surfaces of the container 212. For example, portions 234*a* of the indicating liquid 234 are shown on exterior surfaces of the container neck finish 222. Those of ordinary skill in the art will appreciate that the drawings are merely schematic and are not product blueprint drawings.

Figure 6:
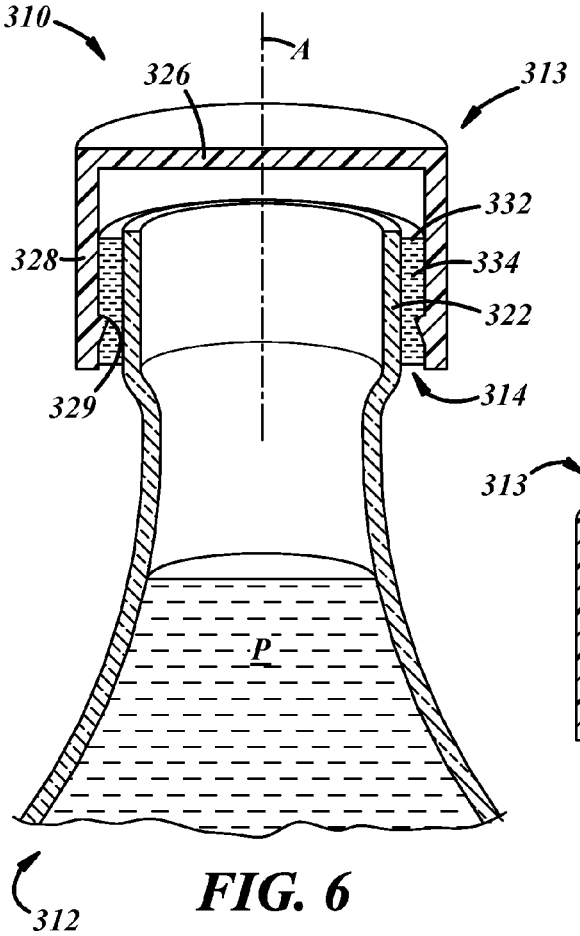
FIG. 6 is an elevational, fragmentary, perspective, cross-sectional view of a portion of a package in accordance with a further illustrative embodiment of the present disclosure, including a container, a closure coupled to the container, and a use indicator positioned between the closure and the container.
Figure 7:
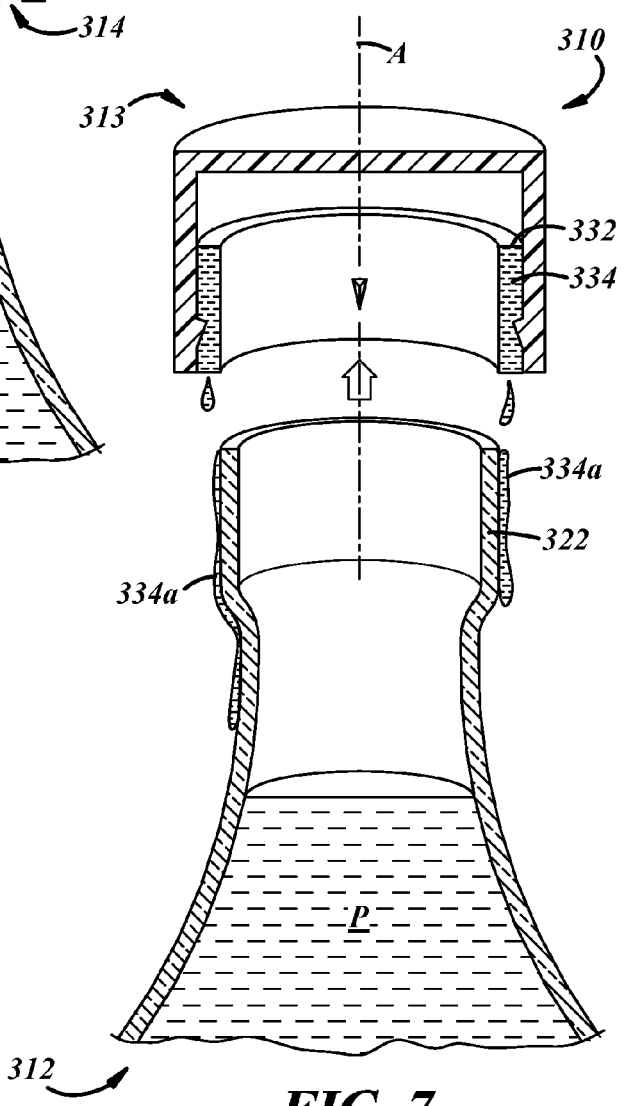
FIG. 7 is an exploded, elevational, fragmentary, perspective, cross-sectional view of the package of FIG. 6, illustrating the closure removed from the container and the use indicator in a ruptured or activated state and a permanent discoloration on the container.

FIGS. 6-7 illustrate another embodiment of a package 310. This embodiment is similar in many respects to the embodiment of FIGS. 1-5 and like numerals among the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 6, a package 310 includes a container 312, a closure 313 coupled to the container 312, a use indicator 314 carried between the closure 313 and the container 312, and a flowable product P carried in the container 312. The container 312 includes a neck finish 322 to which the closure 313 may be coupled, for example, via one or more closure engagement elements (not shown), which may include cooperating threads, bayonet and lug elements, or the like. The closure 313 may include a base wall 326 and a skirt 328 extending axially from the base wall 326 and including one or more container engagement elements (not shown) for cooperation with the closure engagement element(s).

The indicator 314 may include a housing 332 and an indicating liquid 334 carried in the housing 332. The indicator 314 may be radially trapped in direct contact with the skirt 328 of the closure 313 and the neck finish 322 of the container 312. The closure 313 also may include one or more radially inwardly extending projections 329, which may include barbs, pins, or any other suitable structure to puncture the housing 332. In FIG. 6, the indicator 314 is illustrated in an initial or unactivated state.

To remove the closure 313, a user must grasp the skirt 328 tightly to overcome frictional forces coupling the closure 313 to the container 312. Such tight grasping of the closure 313 results in deflection of the skirt 328 in a radially inward direction toward the container neck finish 322. In turn, such deflection causes the projections 329 to puncture the indicator housing 332 and thereby liberate the indicating liquid 334.

With reference to FIG. 7, the housing 332 has ruptured during removal of the closure 313 such that the indicating liquid 334 is released and flows over and permanently discolors one or more surfaces of the container 312. For example, portions 334*a* of the indicating liquid 334 are shown on exterior surfaces of the container neck finish 322. Those of ordinary skill in the art will recognize that the drawings are merely schematic and that, for example, the base wall 326 of the closure 313 may be tightly sealed against the axial end surface of the container neck finish 322 and the like.

Figure 8:
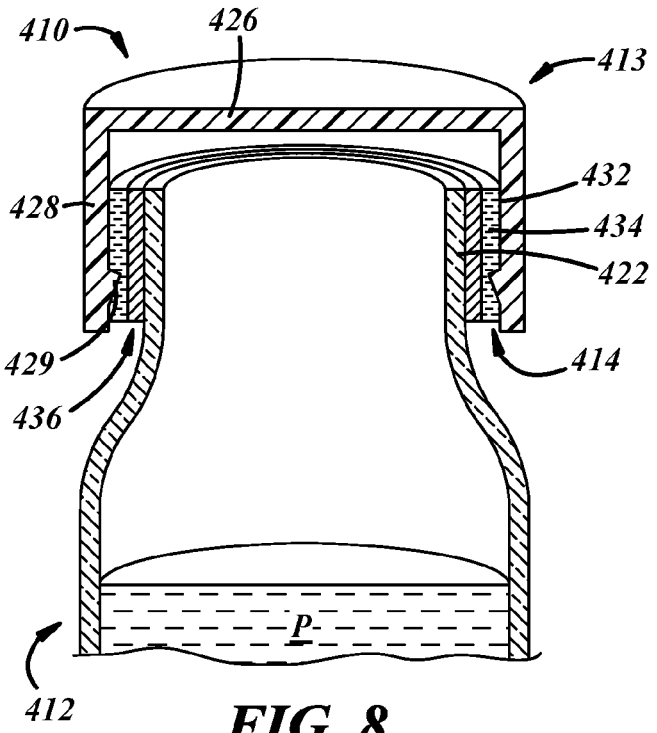
FIG. 8 is an elevational, fragmentary, perspective, cross-sectional view of a portion of a package in accordance with yet another illustrative embodiment of the present disclosure, including a container, a closure coupled to the container, a use indicator positioned between the closure and the container, and a reactive material carried by the container.
Figure 9:
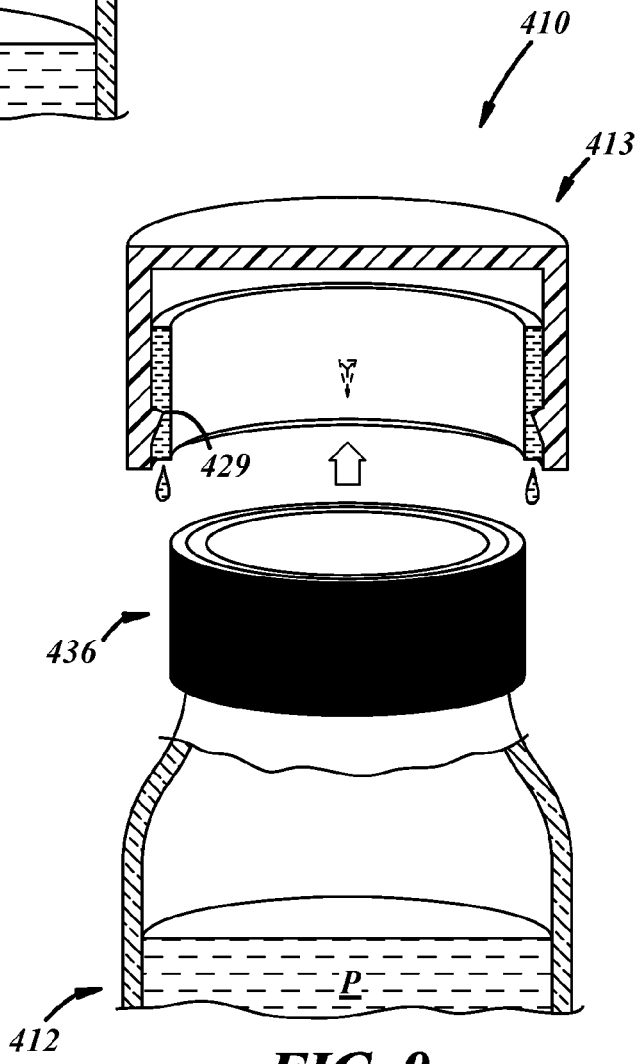
FIG. 9 is an elevational, fragmentary, perspective, cross-sectional view of the package of FIG. 8, illustrating the closure removed from the container and the use indicator in a ruptured or activated state and a permanent discoloration on the container.

FIGS. 8-9 illustrate another embodiment of a package 410. This embodiment is similar in many respects to the embodiment of FIGS. 1-7 and like numerals among the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 8, a package 410 is substantially similar to the package 310 of the previous embodiment and includes a container 412, a closure 413 coupled to the container 412 and including one or more projections 429, a use indicator 414 carried between the closure 413 and the container 412, and a flowable product P carried in the container 412. The container 412 includes a neck finish 422 to which the closure 413 may be coupled in any suitable manner. The closure 413 may include a base wall 426 and a skirt 428 extending axially from the base wall 426. The indicator 414 includes a housing 432 and an indicating liquid 434 carried therein.

The container 412 includes a reactive material 436 on the container neck finish 422, for instance, on an outer annular surface thereof. The material 436 is reactive with the indicating liquid 434 to change the coloration of the container 412. For example, the material 436 may include a reactive ink, and the indicating liquid 434 may include an activator material to activate the reactive ink from one visible state to another. For example, the reactive ink may change from blue to red, or translucent to opaque, or clear to dark, or the like. Examples of stimuli-responsive or reactive inks or colorants could be formulated through the incorporation of acid/base indicators, for instance, similar to Thymol Blue, Methylene Orange, Methyl Red, Phenol Red, or the like, and pairing of the responsive or reactive coating or ink with an indicating liquid containing a suitable acid or base, for instance, acetic acid, citric acid, sodium carbonate, sodium bicarbonate, or the like. The material 436 may be a coating, a layer, or a separate element. In FIG. 7, the indicator 414 is illustrated in an initial or unactivated state.

With reference to FIG. 9, the housing 432 has ruptured during removal of the closure 413 such that the indicating liquid 434 is released and flows over and reacts with the material 436 on the container 412 to permanently discolor one or more surfaces of the container 412.

Figure 10:
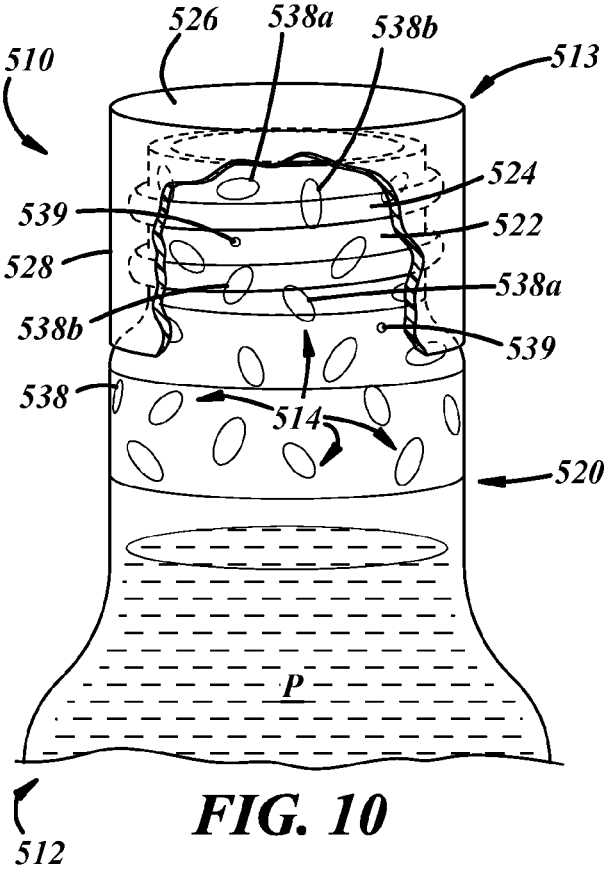
FIG. 10 is a fragmentary perspective view of a portion of a package in accordance with another illustrative embodiment of the present disclosure, including a container, a closure coupled to the container, and a use indicator coated to the container between the closure and the container and shown in an initial or unactivated state.
Figure 11:
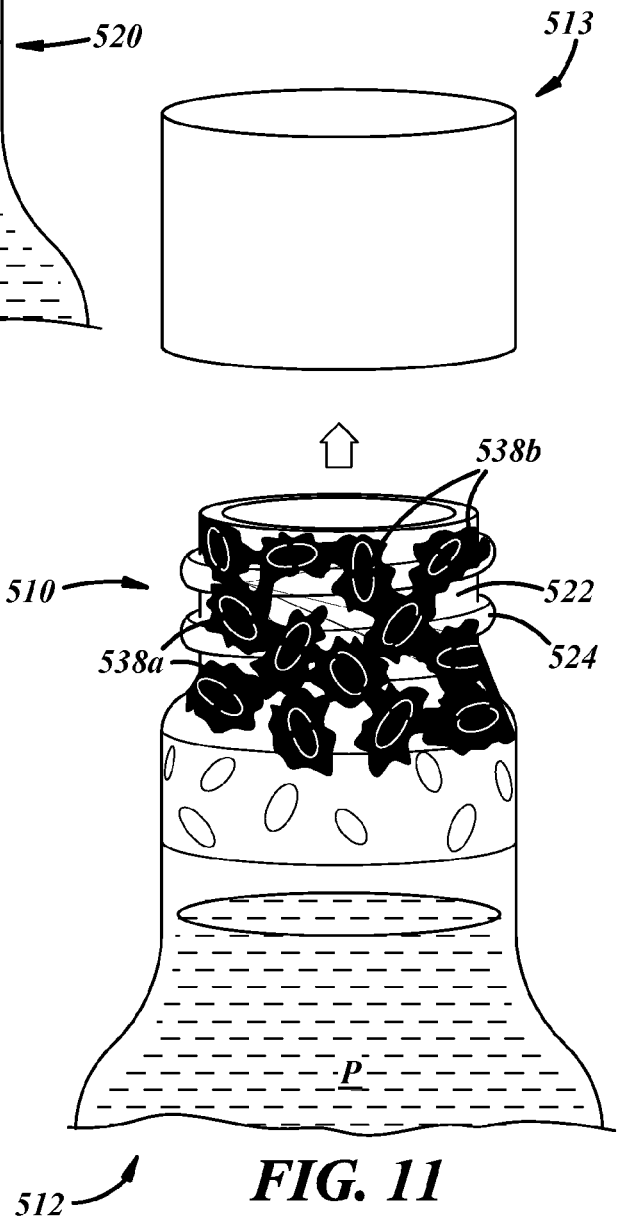
FIG. 11 is an exploded, fragmentary, perspective view of the package of FIG. 10, illustrating the closure removed from the container and showing the use indicator in an activated state and a permanent discoloration on the container.

FIGS. 10-11 illustrate another embodiment of a package 510. This embodiment is similar in many respects to the embodiment of FIGS. 1-9 and like numerals among the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 10, a package 510 includes a container 512 having a neck 520, a closure 513 coupled to the container 512, a use indicator 514 carried between the closure 513 and the container 512, and a flowable product P carried in the container 512. The container 512 includes a neck finish 522 to which the closure 513 may be coupled, for example, via one or more closure engagement elements 524. The closure 513 may include a base wall 526 and a skirt 528 extending axially from the base wall 526 and including one or more container engagement elements (not shown) for cooperation with the closure engagement element(s).

The indicator 514 may include a reactive material 538 on one or more exterior surfaces of the container 512 in a location between the container 512 and the closure 513 when the closure 513 is applied to the container 512. The material 538 may include a first plurality of microcapsules 538*a* including a first reactant and a second plurality of microcapsules 538*b* including a second reactant different from the first reactant. In FIG. 10, the indicator 514 is illustrated in an initial or unactivated state. The indicator reactive material 538 may be wet when applied to surfaces of the container 512. Therefore, the lubricity of the material 538 allows the microcapsules 538*a,b* to flow without rupturing during application of the closure 513 to the container 512. However, upon drying of the material 538, the microcapsules 538*a,b* are fixed within the material 538 and cannot flow upon removal of the closure 513.

To remove the closure 513, a user must grasp the skirt 528 tightly to overcome frictional forces coupling the closure 513 to the container 512. Such tight grasping of the closure 513 results in deflection of the skirt 528 in a radially inward direction toward the container neck finish 522. In turn, such deflection causes the skirt 528 to crush at least some of each of the pluralities of microcapsules 538*a*, 538*b* and thereby liberate the corresponding first and second reactants.

With reference to FIG. 11, upon removal of the closure 513 from the container 512, at least some of the microcapsules 538*a*, 538*b* rupture, and at least some of each of the first and second reactants mix and react with one another to change a coloration of the indicator 514 to discolor one or more surfaces of the container 512. For example, as shown in FIG. 10, the material 538 may be clear or at least translucent. But, as shown in FIG. 11, after rupture of the microcapsules 538*a*, 538*b* and mixing and reaction of the reactants, the coating 514 may appear dark or at least opaque.

In another embodiment, and as shown in FIG. 10, the indicator 514 may include forensic taggants 539. The container 512 can be interrogated to detect presence of the taggants 539 to verify that the container 512 is authentic. Examples of such taggants may include rare earth phosphor compounds that are difficult to source and replicate, DNA marking from unique plant species, or any other suitable taggants. The taggants can be interrogated by electronic taggant reading devices or interrogators that can analyze the composition of the material and determine the presence or absence of taggants.

Figure 12:
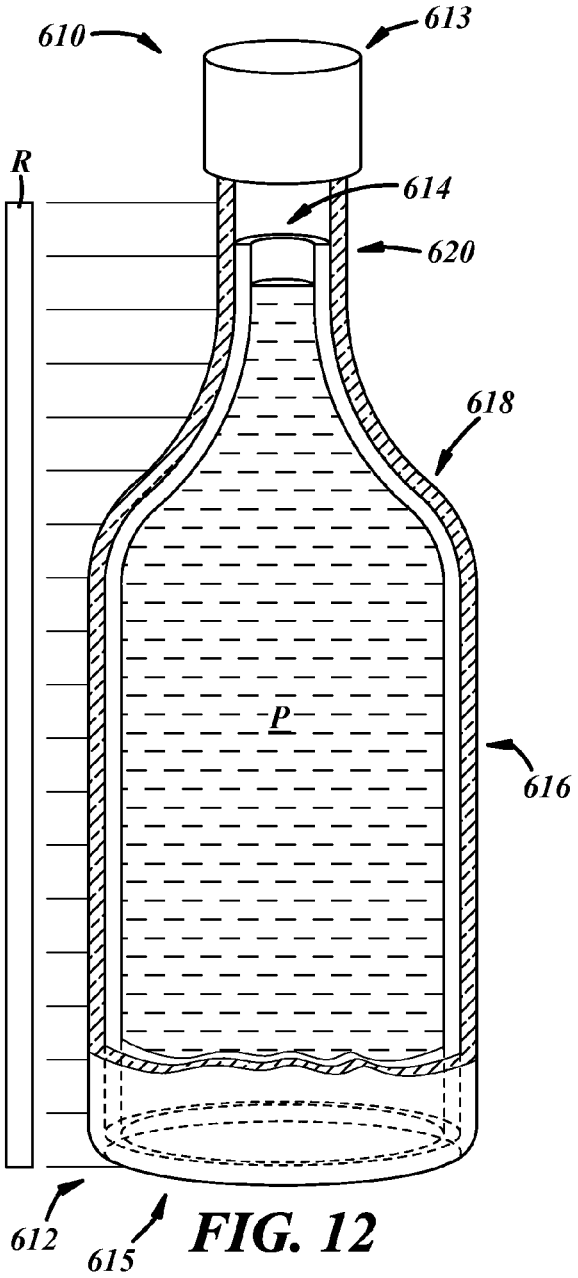
FIG. 12 is a fragmentary, perspective, cross-sectional view of a package in accordance with still another illustrative embodiment of the present disclosure, including a container, a closure coupled to the container, and a use indicator coated to an inside surface of the container and in an initial or unactivated state.
Figure 13:
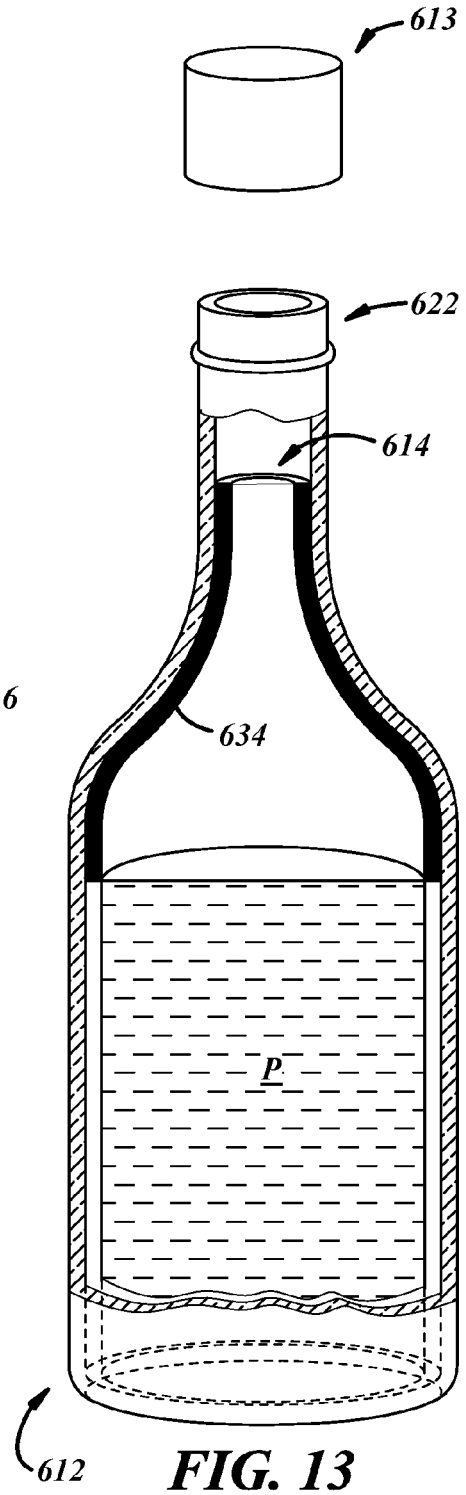
FIG. 13 is a fragmentary, perspective, cross-sectional view of the package of FIG. 12, illustrating the closure removed from the container and the use indicator in a partially activated state.

FIGS. 12-13 illustrate another embodiment of a package 610. This embodiment is similar in many respects to the embodiment of FIGS. 1-11 and like numerals among the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 12, the package 610 includes a container 612, a closure 613 coupled to the container 612, a use indicator 614 carried inside the container 612, and a flowable product P carried in the container 612. The container 612 includes a base 615, a body 616 extending from the base 615, a shoulder 618 extending from the body 616, a neck 620 extending from the shoulder 618, and a neck finish 622 (FIG. 13) to which the closure 613 may be coupled in any suitable manner.

The indicator 614 includes an air-reactive material on one or more interior surfaces of the container 612 that, upon contact with air, irreversibly changes a coloration of the container 612 and, thus, of the package 610, to indicate to a user that the flowable product P has been removed. In this embodiment, the indicator 614 does not include a protective material. Instead the air-reactive material is composed of a material that is visually responsive to irradiation. In FIG. 12, the indicator 614 is illustrated in an initial or unactivated state.

In production, the container 612 may be produced and then the indicator 614 may be applied as a coating to one or more of the inside surfaces of the container 612. For example, the entirety of the interior surfaces of the container 612 may be coated, or just an isolated area of an interior surface of the container 612, or anything therebetween. In any case, because the air-reactive indicator 614 is exposed to air during application to the container 612, the indicator 614 may exhibit an initial state of a coloration. For example, the indicator 614 may be opaque, a dark color, or the like. Thereafter, flowable product P may be flowed into the container 612 and the container 612 may be closed by coupling the closure 613 thereto under a vacuum condition and/or in an oxygen-free environment in any suitable manner.

According to the present disclosure, the indicator 614 may be irradiated to actively set the coloration to a second state, for example, to translucent, a light color, or the like. A radiation source R may be used to irradiate the indicator 614, such that radiation from the source R is absorbed by the indicator 614 in the container 612, thereby causing the indicator 614 to visibly respond by changing to the second state. The radiation source may be used to apply ultraviolet radiation to the indicator 614, but any suitable type of radiation and source may be used.

With reference to FIG. 13, after removal of the closure and dispensing or other removal of at least a portion of the flowable product P, a corresponding portion 634 of the indicator 614 is exposed to air. Such exposure passively resets the indicator 614 back to its initial state of the coloration.

In one embodiment, the flowable product P need not be dispensed or otherwise removed from the container 612 for the indicator 614 to change state. For example, with reference to FIG. 12, the level of the flowable product P is below a level of the indicator 614. Accordingly, when the closure 613 is removed from the container 612 to open the package 610, air will enter the container 612 and contact the uncovered portion of the indicator 614 to change the state of that portion of the indicator 614, thereby providing an indication to a user that the package 610 has been opened.

Figure 14:
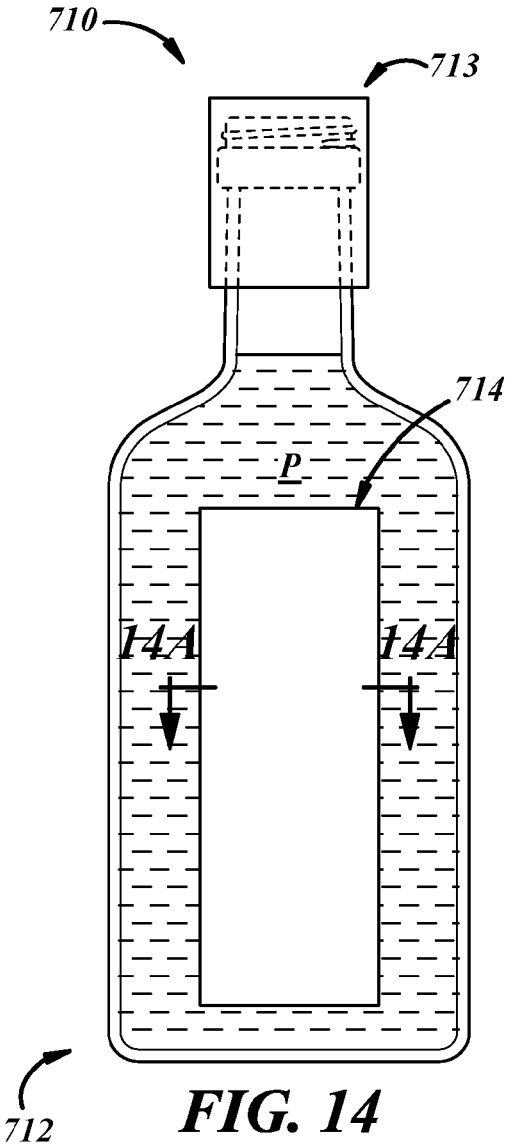
FIG. 14 is an elevational view of a package in accordance with another illustrative embodiment of the present disclosure, including a container, a closure coupled to the container, and a use indicator coated to an inside surface of the container and in an initial or unactivated state.
Figure 15:
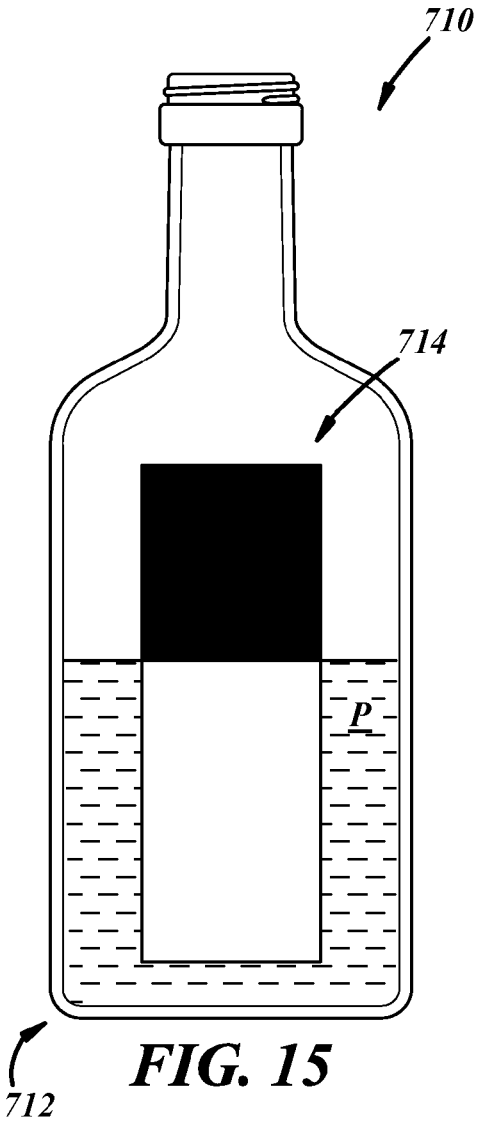
FIG. 15 is an elevational view of the container of FIG. 14, illustrating the closure removed from the container and the use indicator in a partially activated state.

FIGS. 14-15 illustrate another embodiment of a package 710. This embodiment is similar in many respects to the embodiment of FIGS. 1-13 and like numerals among the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 14, the package 710 includes a container 712, a closure 713 coupled to the container 712, a use indicator 714 carried inside the container 712, and a flowable product P carried in the container 712. The indicator 714 is illustrated in an initial or unactivated state.

Figure 14A:
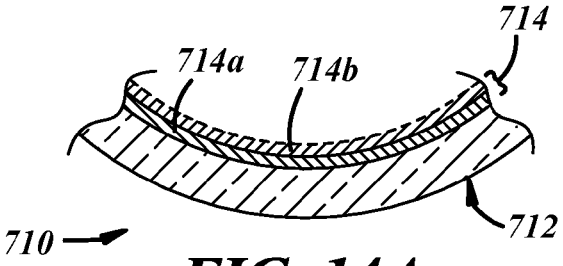
FIG. 14A is an enlarged, fragmentary, cross-sectional view of a portion of the container of FIG. 14.

With reference to FIG. 14A, the indicator 714 may be of any suitable composition(s) and constructed in any suitable manner to enable the indicator 714 to exhibit different colorations. The indicator 714 may be composed of a base material 714*a* carried by one or more inside surfaces of the container 712, and a protective material 714*b* carried, in turn, by the base material 714*a*. In the embodiment illustrated in FIG. 14A, the protective material 714*b* is carried directly on the base material 714*a*, and may be a coating, a layer, or a separate element.

For example, the base material 714*a* may include an air-reactive material that reacts with any one or more of the constituents of air so as to visibly change appearance of the material. For example, the air-reactive material may include, more particularly, an oxygen-reactive material or a nitrogen-reactive material. More specifically, the air-reactive material may include oxygen-reactive metals, polymers, or dyes. For instance, the air-reactive material may include copper, iron, potassium, sodium, PEN (polyethylene naphthalate), or polycarbonate.

The protective material 714*b* may include a protective coating, protective component, or any other suitable protective element that may be composed of a protective material that is impermeable to any one or more of the constituents of air so as to protect the base material 714*a*, but that is readily dissolvable by the product in the container 712 so as to prepare the base material 714*a* for exposure to air when the package 710 is opened and product is dispensed therefrom. For example, the protective material may include polyacrylic acid, polyacrylamide, xanthan gum, pectin, chitosan derivatives, dextran, carrageenan, guar gum, and/or cellulose ethers, for instance, hydroxypropylmethyl cellulose (HPMC), hydroxypropyl cellulose (HPC), hydroxyethyl cellulose (HEC), and/or sodium carboxy methyl cellulose (Na-CMC).

The indicator 714 may be produced in any suitable manner. For example, the base material 714*a* may be assembled, sprayed, or otherwise applied to the inside of the container 712 in any suitable manner. Likewise, the protective material 714*b* may be assembled, sprayed, or otherwise applied over the base material 714*a* in any suitable manner. The indicator 714 may be applied to the container 712 in an inert environment, for example, under vacuum conditions and/or in an oxygen-free environment.

The base material 714*a* may exhibit a first coloration, for example, a first color, hue, or translucency. But when exposed to air, for example, after removal of the material 714*b*, the base material 714*a* may exhibit a second coloration, for example, a second color, hue, or translucency. In one embodiment, the material 714*b* may be transparent or at least translucent, such that the coloration of the base material 714*a* is visible.

With reference to FIG. 15, the use indicator 714 provides an indication that at least some of the flowable product P has been poured out of the container 712, withdrawn from the container 712 via suction or the like, or otherwise dispensed or removed from the container 712 in any other manner. But it is also contemplated that the use indicator 714 could provide an indication of closure removal and subsequent exposure to air. For example, the indicator 714 or at least a portion thereof, could be located above the level of the flowable product P in the container 712.

The embodiments of FIGS. 12-15 are similar to embodiments disclosed and shown in U.S. patent application Ser. No. 13/832,589 filed Mar. 15, 2013 (entitled CONTAINER HAVING A USE INDICATOR), which was filed on the same date as the present application and is assigned to the assignee hereof and is incorporated herein by reference in its entirety.

Figure 16:
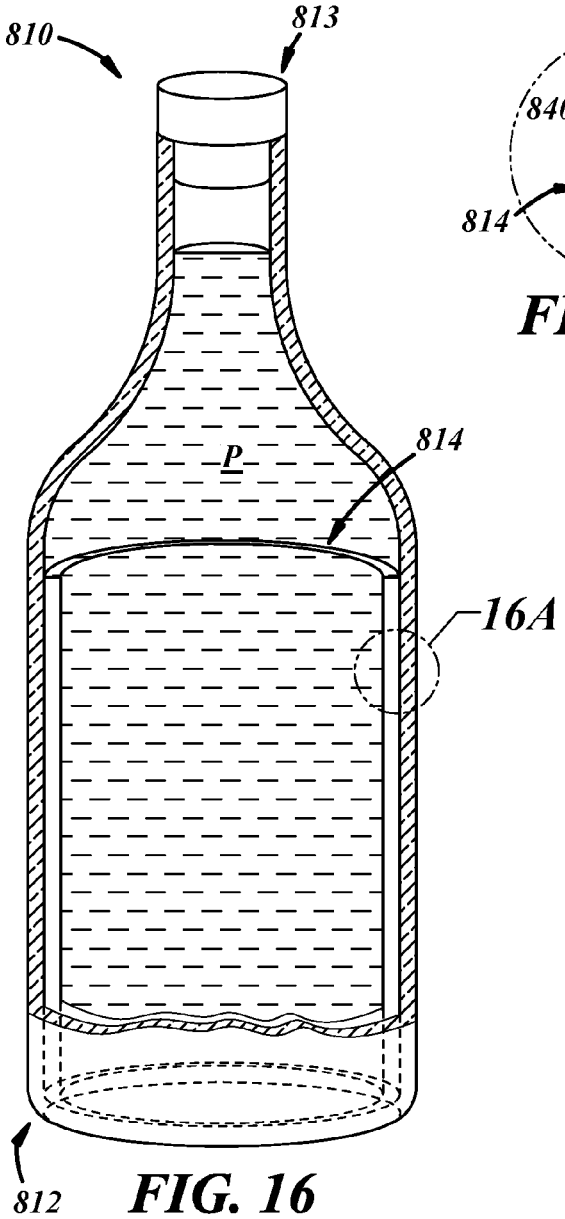
FIG. 16 is a fragmentary, perspective, cross-sectional view of a package in accordance with another illustrative embodiment of the present disclosure, including a container, a closure coupled to the container, and a use indicator coated to an inside surface of the container and in an initial or unactivated state.
Figure 17A:
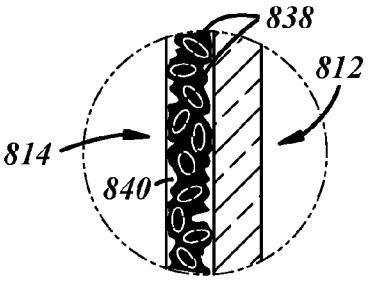
FIG. 17A is an enlarged, fragmentary, cross-sectional view of a portion of the container of FIG. 17.
Figure 17:
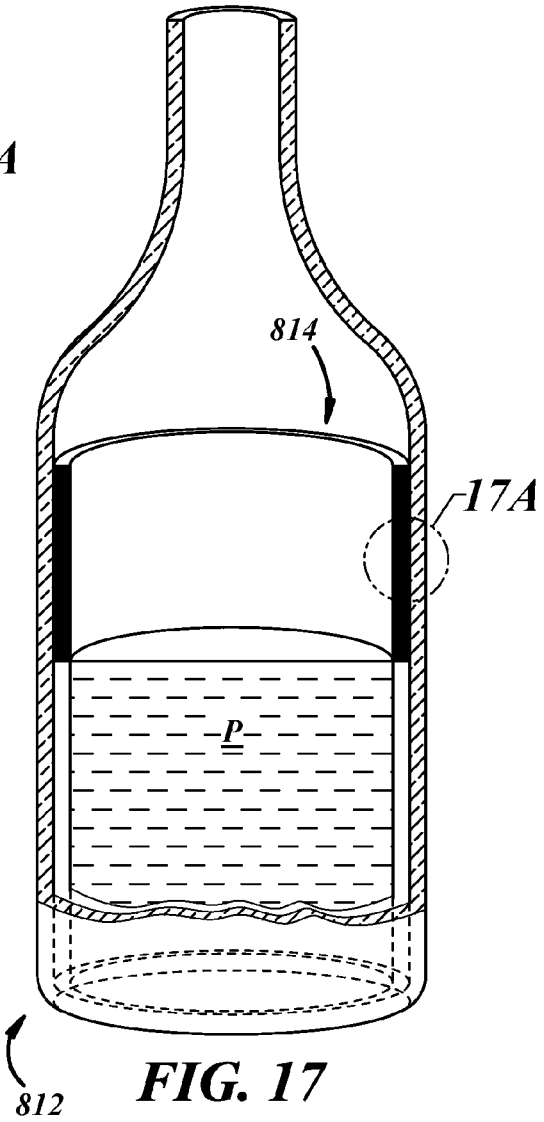
FIG. 17 is a fragmentary, perspective, cross-sectional view of the package of FIG. 16, illustrating the closure removed from the container and the use indicator in a partially activated state.

FIGS. 16-17A illustrate another embodiment of a package 810. This embodiment is similar in many respects to the embodiment of FIGS. 1-15 and like numerals among the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 16, the package 810 includes a container 812, a closure 813 coupled to the container 812, a use indicator 814 carried inside the container 812, and a flowable product P carried in the container 812.

Figure 16A:
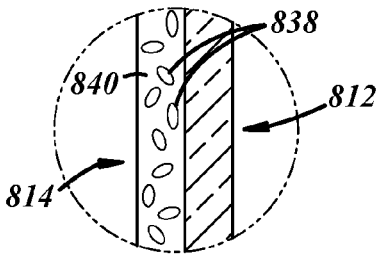
FIG. 16A is an enlarged, fragmentary, cross-sectional view of a portion of the container of FIG. 16.

With reference to FIG. 16A, the indicator 814 may be of any suitable composition(s) and constructed in any suitable manner to enable the indicator 814 to exhibit different colorations. The indicator 814 may be composed of microcapsules 838 carried in a forward osmosis membrane 840. The indicator 814 may be applied to the container 812 by spraying the indicator 814 as a coating that includes microcapsules suspended in a liquid membrane material, or by applying the indicator 814 as a film that includes microcapsules and is inserted as a sleeve and then blown into tight contact with the container interior, or via any other suitable technique. The microcapsules 838 may contain an indicating liquid, for example, a stain, dye, ink, or the like. The forward osmosis effect is controlled by the movement of water, which may be an integral part of the flowable product P. Because only water is permitted to transport through the membrane 840 there is limited risk of cross contamination of the product P with the indicating liquid. Also, forward osmosis membranes are used in water filtration systems and, thus, are considered safe. Once the container 812 is filled with the flowable product P, the microcapsules 838 will be hydrated via the forward osmosis process. In FIGS. 16 and 16*a*, the indicator 814 is illustrated in an initial or unactivated state.

But, with reference to FIG. 17, removal of the flowable product P from the container 812 will stop the forward osmosis process for that portion of the indicator which is no longer in contact with the liquid flowable product P. As shown in FIG. 17A, this will cause the microcapsules 838 to dehydrate and rupture so that the indicating liquid permanently discolors the container 812 and/or the membrane 840.

Figure 18:
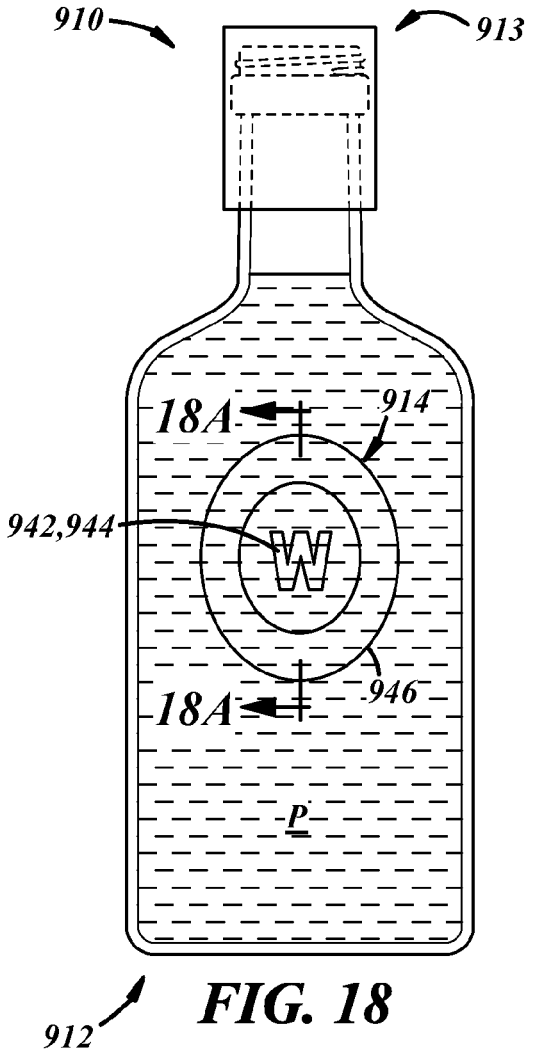
FIG. 18 is an elevational view of a package in accordance with another illustrative embodiment of the present disclosure, including a container, a closure coupled to the container, and a use indicator coupled to an exterior surface of the container and in an initial or unactivated state.
Figure 19:
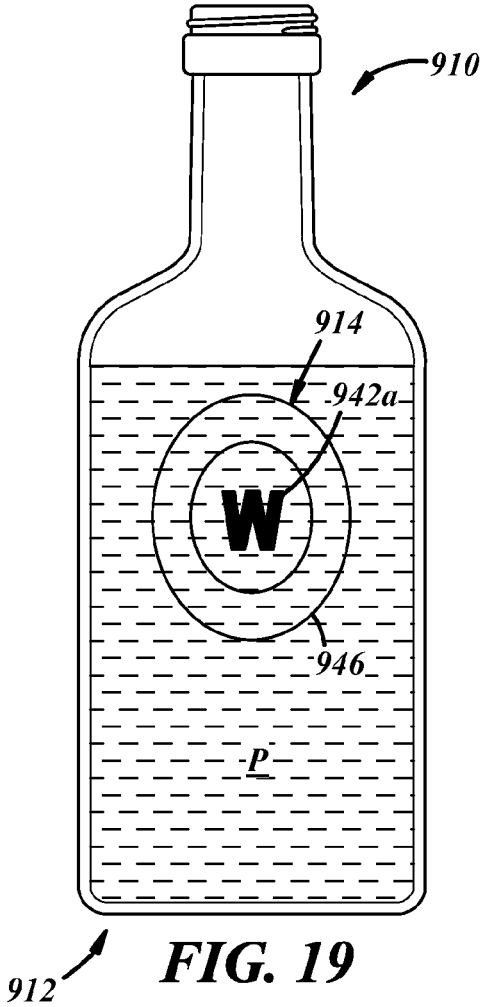
FIG. 19 is an elevational view of the container of FIG. 18, illustrating the use indicator in an activated state.
Figure 19A:
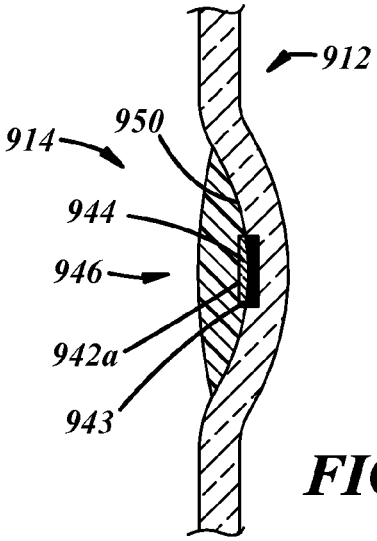
FIG. 19A is an enlarged, fragmentary, cross-sectional view of a portion of the container of FIG. 19.
Figure 20:
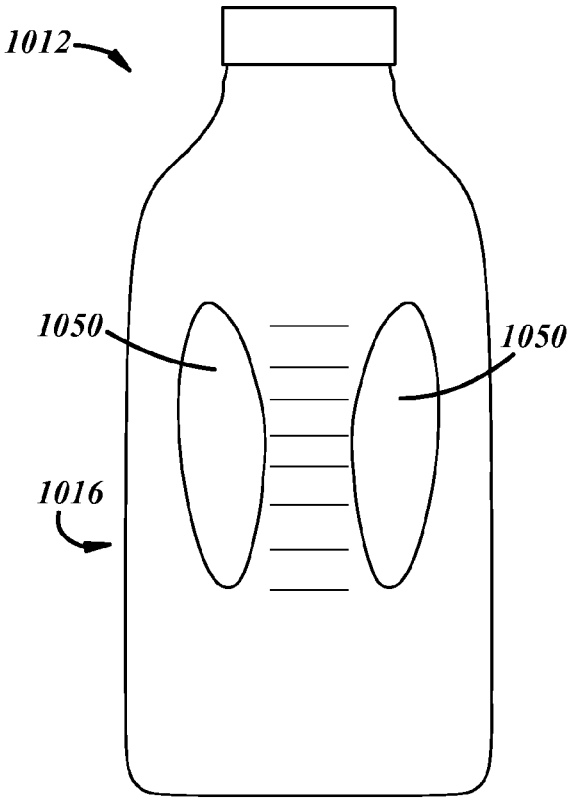
FIG. 20 is a rear elevational view of a container in accordance with another illustrative embodiment of the present disclosure, including grip recesses, which may accept the use indicator of FIG. 19A therein.
Figure 21:
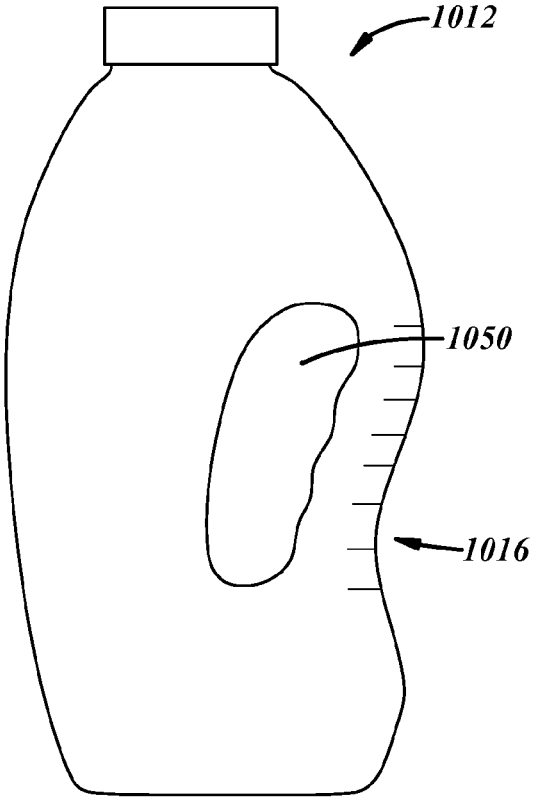
FIG. 21 is a side elevational view of the container of FIG. 20.

FIGS. 18-21 illustrate additional embodiments of containers 912 (FIGS. 18-19A) and 1012 (FIGS. 20-21). These embodiments are similar in many respects to the embodiment of FIGS. 1-17 and like numerals among the embodiments generally designate like or corresponding elements throughout the several views of the drawing figures. Accordingly, the descriptions of the embodiments are incorporated into one another, and description of subject matter common to the embodiments generally may not be repeated here.

Figure 18A:
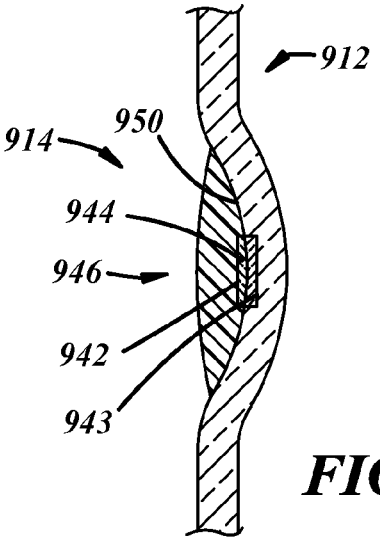
FIG. 18A is an enlarged, fragmentary, cross-sectional view of a portion of the container of FIG. 18.

With reference to FIGS. 18 and 18A, the package 910 includes a container 912, a closure 913 coupled to the container 912, a use indicator 914 carried by the container 912, for instance, in a recess 950 of a container wall, and a flowable product P carried in the container 912.

The use indicator 914 includes a capsule 942 that may include a relatively soft membrane and an etchant carried in the membrane, wherein the capsule 942 may be carried in a cavity 943 (FIG. 18A) in an external surface of the container 912, for example, within the larger recess 950. The indicator 914 also includes a capsule activator 944 that may include a relatively rigid member, for example, a piece of glass or plastic that may correspond in shape and size to the cavity 943 so as to be depressible into the cavity 943. The indicator 914 also may include a cover 946 that may include a relatively soft and flexible material, for example, an elastic material. The cover 946 may seal to the container 912 to sealingly cover the activator 944 and the capsule 942. The outer surface of the cover 946 may be recessed below corresponding outer surfaces of the container 912, as illustrated.

Any suitable materials may be used for the indicator 914. For example, the indicator 914 may include an etchant, which may include barium sulfate, sulfuric acid, sodium bifluoride, ammonium bifluoride, or any other suitable material. In another example, the indicator 914 may include a colorant as described previously above. The cavity 943 may be formed during manufacturing of the container 912 and may be provided in the form any suitable graphic, indicia, or the like, for example, for branding the container 912. The activator 944 may be composed of the same material as the container, for example, glass or any other suitable material. The cover 946 may be composed of plastic, thin film metal, or any other suitable material. In FIG. 18, the indicator 914 is illustrated in an initial or unactivated state.

In one embodiment of use, the package 910 may be designed in such a way that the activator 944 would have to be pressed into the cavity 943 in order to remove the closure 913. For example, the activator 944 could be provided on the container 912 in a location that overlaps and ordinarily interferes with closure rotation, such that the activator 944 would need to be pressed to allow closure rotation. For example, the activator 944 could be a lever ordinarily in a position of interference with the closure 913 and pivotable about its fulcrum to a position of clearance with respect to the closure 913 to allow rotation of the closure 913.

In another embodiment of use, the activator 944 could be provided on a surface of the container 912 in an area specifically designed for gripping by the consumer, for example, in a set of recessed finger grips, or in a concave portion of the container 912 that would be a natural location for the consumer to grip the container 912 when removing the closure 913 and/or pouring the flowable product P from the container 912.

For example, and with reference to FIGS. 20 and 21, a container 1012 may include grip recesses 1050 in or on a body 1016 of the container 1012. The use indicator 914 of FIGS. 18-19A may be carried in one or both of the recesses 1050 of FIGS. 20 and 21.

In any of the aforementioned embodiments, the pressing or gripping action on the activator 944 would rupture the capsule 942, thereby releasing the etchant. Eventually, the etchant would etch the glass of the container 912 and/or the activator 944, thereby rendering a frosty visible appearance 942*a* (FIG. 19). The package 910 may be packaged in secondary packaging materials such as a cardboard, plastic or metal box for shipping and sale to the consumer to protect against premature engagement or pressing of the activator 944.

In a further embodiment, a use indicator may be provided in the form of a wick, as disclosed and shown in U.S. patent application Ser. No. 13/832,628 filed Mar. 15, 2013 (entitled WICK TO INDICATE PACKAGE OPENING), which was filed on the same date as the present application and is assigned to the assignee hereof and is incorporated herein by reference in its entirety.

The present disclosure also may include one or more methods of discouraging reuse of a container after opening of the container. The method(s) include the step of applying a permanent discoloration to the container, which discoloration is observable by a potential user to indicate that the container has already been used. The step of applying a permanent discoloration to the container may be carried out by a process selected from the group consisting of the following processes:

(1) applying a sticker to the outside of the container and the closure, which sticker contains a dye that is released when the closure is removed from the container (this process may be carried out in accord with the teachings of the embodiment disclosed in conjunction with FIGS. 1-2);

(2) placing a packet of dye in a closure, which packet is ruptured upon removal of the closure from the container to release the dye (this process may be carried out in accord with the teachings of the embodiments disclosed in conjunction with FIGS. 3-5 and FIGS. 6-7);

(3) placing a reactive ink on an exterior surface of the container and an actuator material in a closure in such a way as to be released when the closure is removed from the container to release the actuator material and activate the reactive ink (this process may be carried out in accord with the teachings of the embodiment disclosed in conjunction with FIGS. 8-9);

(4) placing microcapsules on an exterior surface of the container in such a way that at least some of the microcapsules are crushed when a closure is removed from the container, the microcapsules containing reactants that react with each other to generate a detectable spectral shift (this process may be carried out in accord with the teachings of the embodiment disclosed in conjunction with FIGS. 10-11);

(5) placing air-reactive materials on an interior surface of the container such that, when the container is opened and/or contents of the container are removed, the air-reactive materials are exposed to air, thereby causing a detectable spectral shift (this process may be carried out in accord with the teachings of the embodiments disclosed in conjunction with FIGS. 12-13 and FIGS. 14-15);

(6) coating the interior surface of the container with microcapsules embedded in a forward osmosis membrane, such that the microcapsules rupture and permanently discolor at least one of the membrane material or the container when the contents are removed from the container (this process may be carried out in accord with the teachings of the embodiment disclosed in conjunction with FIGS. 16-17A); and (7) carrying a capsule of etchant material on a container in such a way that the etchant material is released to change the appearance of the container upon rupture of the capsule caused by a user (this process may be carried out in accord with the teachings of the embodiments disclosed in conjunction with FIGS. 18-21).

There thus has been disclosed a product, package, and methods that fully satisfy all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A product that includes:

a bottle; and a use indicator carried on at least one inside surface of the bottle so that, upon removal of a closure from the bottle or upon removal of flowable product from within the bottle, a coloration of the product changes irreversibly to indicate to a user that the product has been used, wherein the indicator includes, an air-reactive material on the at least one inside surface of the bottle, and a protective material for the air-reactive material that is dissolved by the flowable product upon filling the bottle with the flowable product.

2. A product that includes:

a bottle; and a use indicator carried on at least one inside surface of the bottle so that, upon removal of a closure from the bottle or upon removal of flowable product from within the bottle, a coloration of the product changes irreversibly to indicate to a user that the product has been used, wherein the indicator includes an air-reactive material on the at least one inside surface of the bottle, wherein the air-reactive material includes an air-reactive base material composed of at least one of copper, iron, potassium, sodium, PEN (polyethylene naphthalate), or polycarbonate, and the indicator also includes a protective material over the base material and composed of at least one of polyacrylic acid, polyacrylamide, xanthan gum, pectin, chitosan derivatives, dextran, carrageenan, guar gum, and/or cellulose ethers, for instance, hydroxypropylmethyl cellulose (HPMC), hydroxypropyl cellulose (HPC), hydroxyethyl cellulose (HEC), or sodium carboxy methyl cellulose (Na-CMC).

3. A package including the product set forth in claim 1, a closure coupled to the bottle, and a flowable product carried in the bottle.

4. The package set forth in claim 3 wherein the air-reactive material, upon contact with air, irreversibly changes the coloration to indicate to a user that at least one of the closure or the flowable product has been removed from the bottle.

5. A package including a product that includes:

a bottle;

a closure coupled to the bottle;

a flowable product carried in the bottle; and a use indicator carried on at least one inside surface of the bottle so that upon removal of a closure from the bottle or upon removal of flowable product from within the bottle, a coloration of the product changes irreversibly to indicate to a user that the product has been used, wherein the indicator includes a protective material for the air-reactive material that is dissolved by the flowable product upon filling the bottle with the flowable product.

6. A method of producing a product that includes the steps of:

(a) positioning an indicator inside of a container, wherein the indicator includes a protective material and has a coloration state changeable to another coloration state in response to use of the product;

(b) flowing a flowable product into the container to at least partially cover the indicator and including dissolving the protective material with the flowable product; and (c) assembling a closure to the container.

7. The method set forth in claim 6 wherein the assembling step (c) is conducted under at least one of a vacuum condition or an oxygen-free environment.

8. A product produced by the method set forth in claim 6.

9. A method of using the product set forth in claim 8 that includes:

removing the closure to open the container; and dispensing the flowable product out of the container and over the indicator, such that the indicator is exposed to air and exhibits a different state of coloration that is irreversible to the initial state of coloration.

10. A method of discouraging reuse of a container after opening of the container, which includes the step of: applying a permanent discoloration to the container, which is observable by a potential user to indicate that the container has already been used, wherein said step of applying a permanent discoloration to the container is carried out by placing air-reactive materials on an interior surface of the container and applying a protective material that is dissolvable by flowable product upon filling the bottle with the flowable product such that, when the container is opened and/or contents of the container are removed, the air-reactive materials are exposed to air, thereby causing a detectable spectral shift.

11. The product set forth in claim 1, wherein the air-reactive material includes an air-reactive base material composed of at least one of copper, iron, potassium, sodium, PEN (polyethylene naphthalate), or polycarbonate, and the protective material is disposed over the base material and is composed of at least one of polyacrylic acid, polyacrylamide, xanthan gum, pectin, chitosan derivatives, dextran, carrageenan, guar gum, and/or cellulose ethers, for instance, hydroxypropylmethyl cellulose (HPMC), hydroxypropyl cellulose (HPC), hydroxyethyl cellulose (HEC), or sodium carboxy methyl cellulose (Na-CMC).

12. The package set forth in claim 5, wherein the air-reactive material includes an air-reactive base material composed of at least one of copper, iron, potassium, sodium, PEN (polyethylene naphthalate), or polycarbonate, and the protective material is disposed over the base material and is composed of at least one of polyacrylic acid, polyacrylamide, xanthan gum, pectin, chitosan derivatives, dextran, carrageenan, guar gum, and/or cellulose ethers, for instance, hydroxypropylmethyl cellulose (HPMC), hydroxypropyl cellulose (HPC), hydroxyethyl cellulose (HEC), or sodium carboxy methyl cellulose (Na-CMC).

* * * * *